United States Patent [19]

Gustavsson

[11] 4,099,296

[45] Jul. 11, 1978

[54] METHOD AND APPARATUS FOR FORMING A MATERIAL WEB

[75] Inventor: Lennart Gustavsson, Vaxjo, Sweden

[73] Assignee: Aktiebolaget Svenska Flaktfabriken, Nacka, Sweden

[21] Appl. No.: 725,276

[22] Filed: Sep. 21, 1976

[30] Foreign Application Priority Data

Sep. 26, 1975 [SE] Sweden ..... 7510795

[51] Int. Cl.[2] ..... D04H 1/00

[52] U.S. Cl. ..... 19/304; 156/62.2

[58] Field of Search ..... 19/155, 156–156.4, 19/240, 163; 156/62.2, 62.4, 62.6; 425/80, 81, 82, 83; 28/71 NW; 264/121

[56] References Cited

U.S. PATENT DOCUMENTS

| | | | |
|---|---|---|---|
| 2,315,735 | 4/1943 | Richardson | 425/83 X |
| 2,863,493 | 12/1958 | Snow et al. | 156/62.4 X |
| 2,920,679 | 1/1960 | Sittel | 425/82 X |
| 3,460,731 | 8/1969 | Troth, Jr. | 19/156.3 X |
| 3,485,428 | 12/1969 | Jackson | 19/163 X |
| 3,599,848 | 8/1971 | Thumm et al. | 156/62.4 X |

FOREIGN PATENT DOCUMENTS

| | | | |
|---|---|---|---|
| 709,612 | 5/1954 | United Kingdom | 19/163 |
| 190,555 | 6/1967 | U.S.S.R. | 19/156.3 |
| 247,083 | 5/1970 | U.S.S.R. | 19/156.4 |

*Primary Examiner*—Dorsey Newton

*Attorney, Agent, or Firm*—Dorfman, Herrell & Skillman

[57] ABSTRACT

A web is formed from particulate material, for example wood fibres, by depositing the fibres on a movable deposition surface in a chamber. The particulate material is carried to the surface in an air stream to form a composite material flow which is caused to oscillate across the surface by impulses from separate control means preferably disposed on opposite sides of the stream. The control means is preferably opposed control flows which are caused to vary alternatingly between a minimum and a maximum impulse by use of one or more fluidistors. The fluidistors may be controlled by self-oscillation or by measuring the evenness of the particulate material deposited on the deposition surface. The control may also be effected by adjusting the walls of the chamber to utilize the coanda-effect. The particulate material may be admixed with additives from the control flow and may be charged electrostatically.

33 Claims, 17 Drawing Figures

METHOD AND APPARATUS FOR FORMING A MATERIAL WEB

Figure 1:
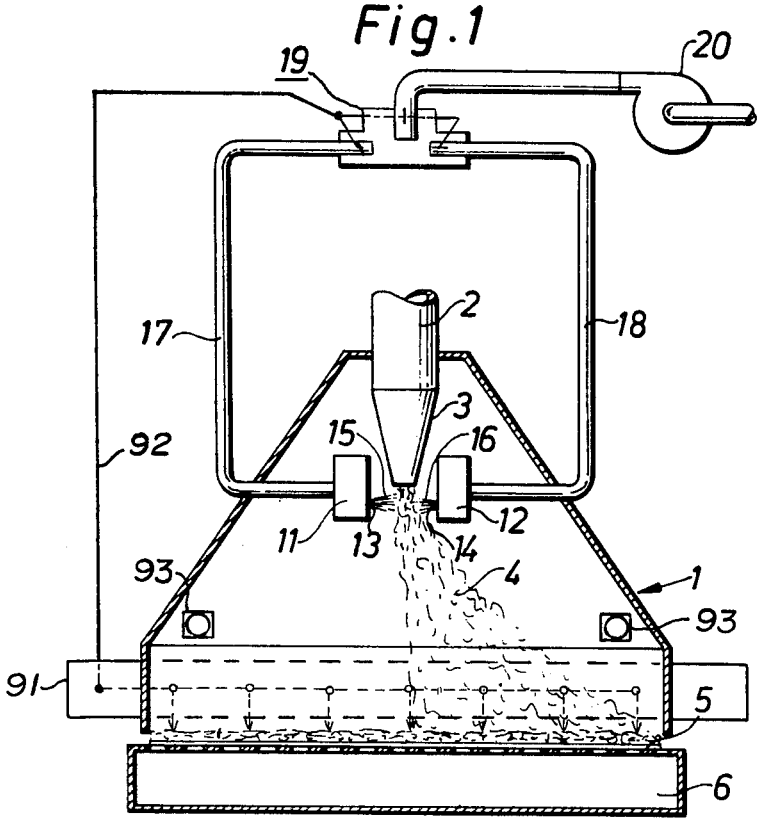

This invention relates to method for forming a material web by causing a flow of particles, for example wood fibres which have been distributed in a gaseous medium flow into a distribution chamber to be deposited or precipitated on a deposition surface provided in the distribution chamber. The invention also relates to an apparatus for carrying out the method.

Several methods are known to form a material web by depositing precipitation of fibres or other particles on a running web. The invention refers to the methods in which the fiber flow is supplied to forming stations suspended in a gas, usually air. According to a known method, the fibres are supplied to a dispersion head provided with perforations, through which the fibres are passed by means of rotating brushes or wings. As an example of such an installation, the Swedish patent specification No. 203,373 and the corresponding U.S. Pat. No. 3,056,173 can be mentioned. One disadvantage of this method is that the apertures in the dispersion member are easily clogged by the fibers, which results in non-uniform fibre distribution. It is, further, difficult to adjust the operation to accommodate fibres of different kind or to control the installation when changing fibre quality.

Another principle of fibre distribution is disclosed in U.S. Pat. No. 3,071,822, according to which the fibres are supplied to an oscillating nozzle, which by a mechanical arrangement is caused to reciprocatingly oscillate over the fibre web. Also this arrangement involves several disadvantages. In practice, for example, the oscillation of the oscillating nozzle is limited to about one oscillation per second, which, in the event of non-uniform material flow, yields a non-uniform web. In order to effect the desired oscillation movement of the oscillating nozzle, complicated mechanical arrangements are required, and it is difficult to adjust said movement to varying fibre qualities. Moreover, there always exists a risk of clogging the mouthpiece of the oscillating nozzle and, consequently, a risk of a breakdown in opertion.

A primary object of the present invention is to improve the method of distributing fibres or particles dispersed in a gaseous medium, which method does not have the disadvantages of the aforesaid methods. This object is achieved by the method of the attached method claims. Due to the invention an efficient distribution of the fibres is obtained, and the method renders it possible to efficiently control the thickness of the web along its lenght in a simple manner. It is, further, easily possible to adjust the operation to different fibre qualities. The risk of clogging with resulting operating breakdowns is eliminated because no mechanical parts are in the fiber flow.

The invention also has the object of providing an apparatus for carrying out the method, which object is achieved by an apparatus as defined in the attached apparatus claims.

Figure 2:
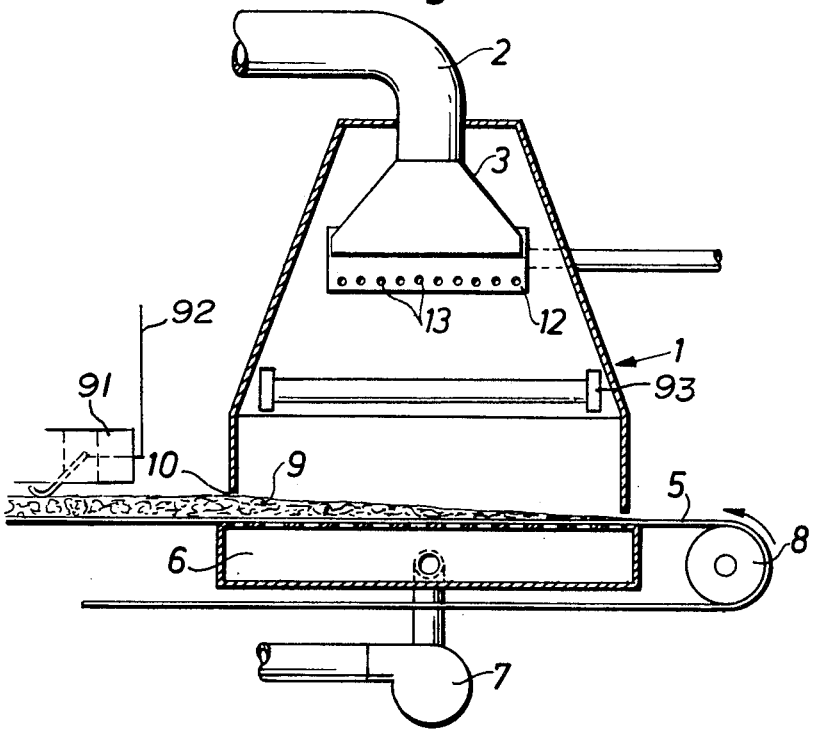
Figure 4A:
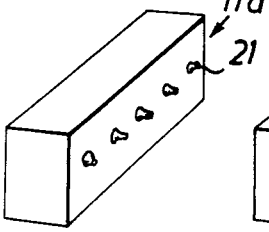
Figure 4B:
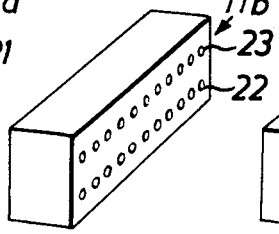
Figure 4C:
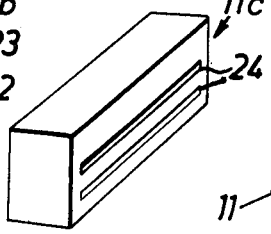
Figure 4D:
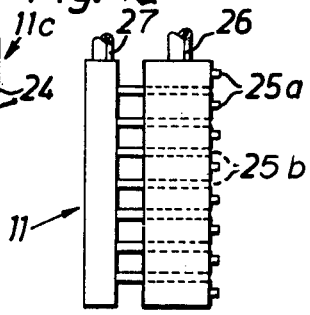
Figure 5:
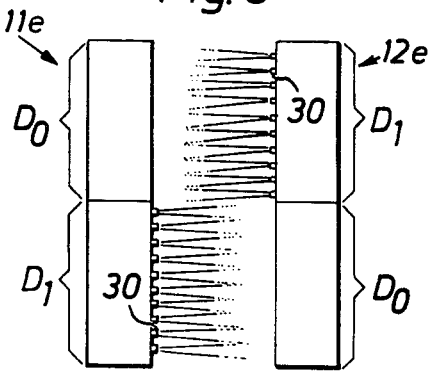
Figure 6:
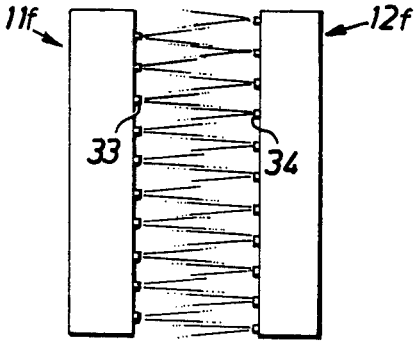
Figure 3:
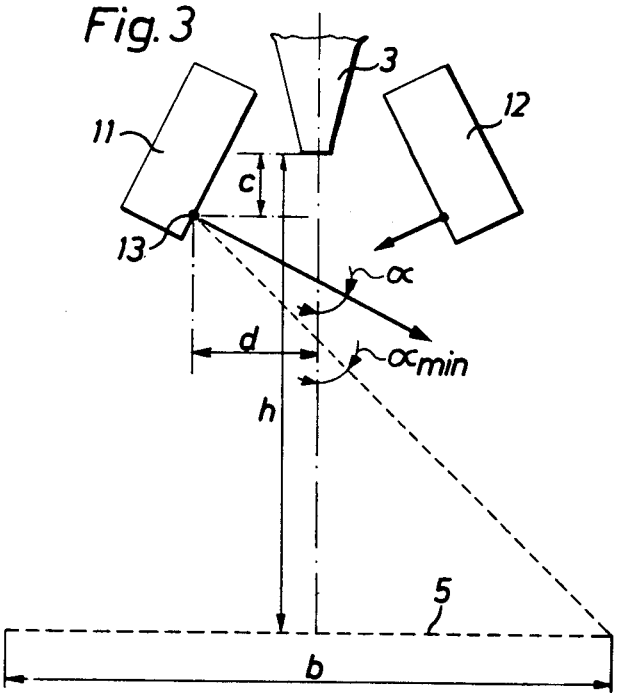
Figure 7:
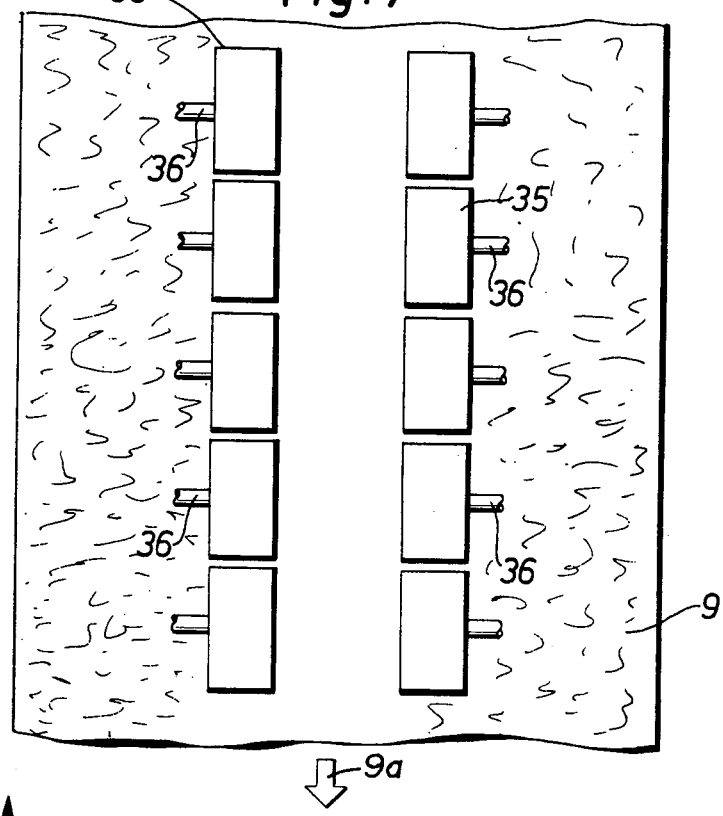
Figure 8:
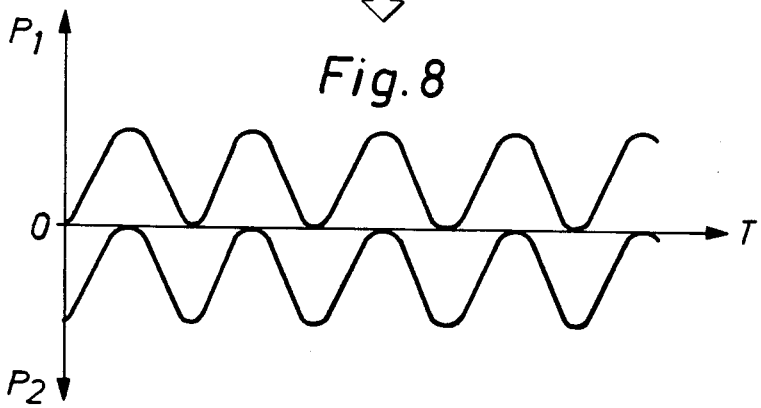
Figure 9:
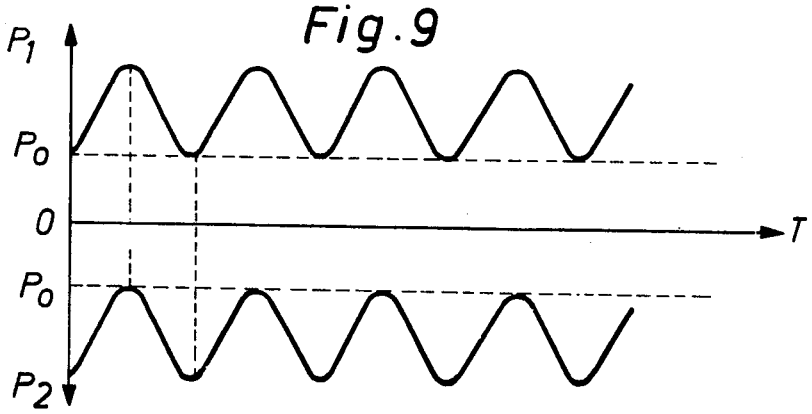
Figure 10:
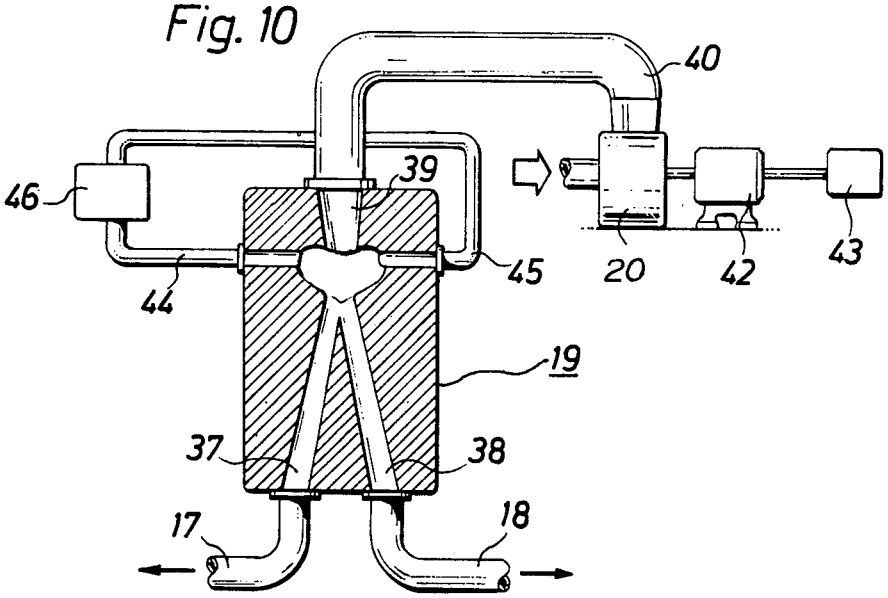
Figure 11A:
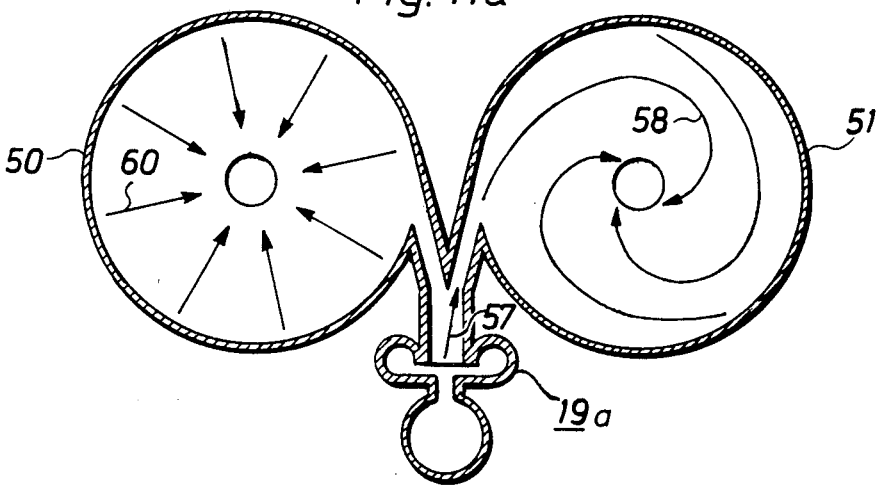
Figure 11B:
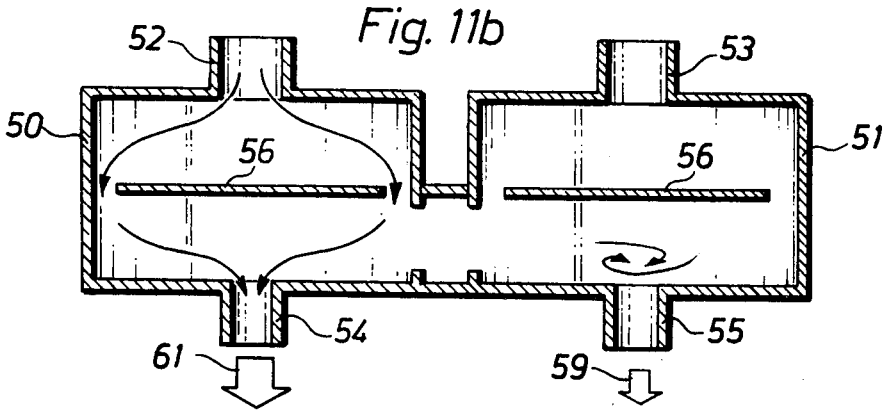
Figure 12:
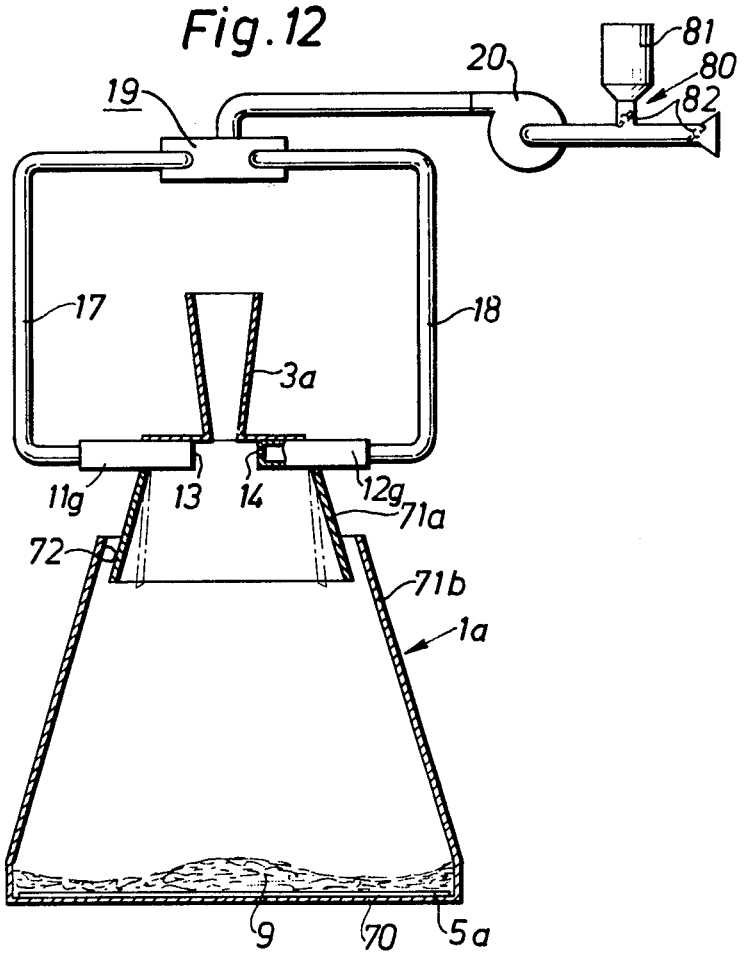
Figure 13:
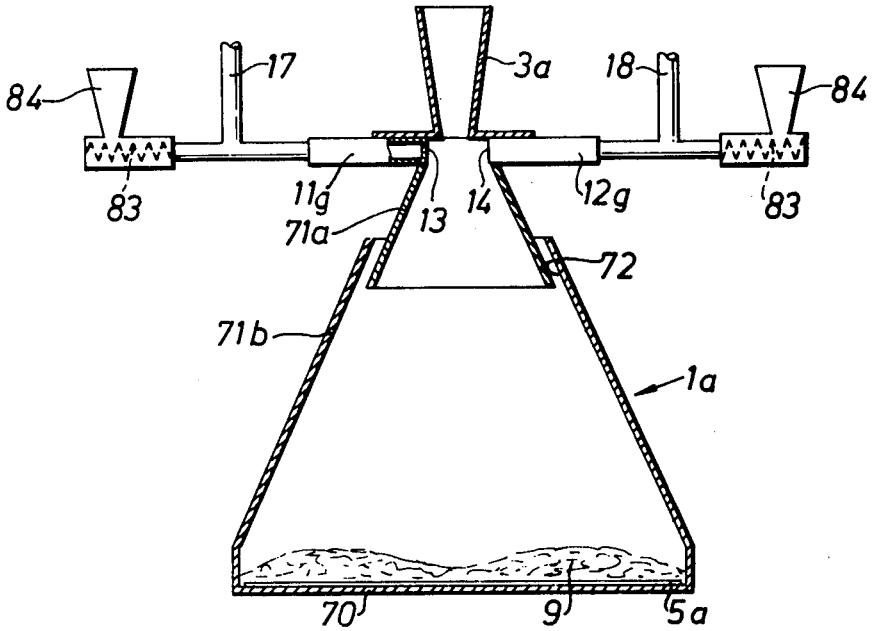

The invention is described in greater detail in the following, with reference to the accompanying schematic drawings, in which:

FIG. 1 is a cross-section through a forming station according to the invention, FIG. 2 is a longitudinal section through the same forming station, FIG. 3 is a section transverse to the installation to define some important parameters, FIGS. 4*a* thru 4*d* show some different embodiments of blowing boxes, FIG. 5 shows a blowing box arrangement, FIG. 6 shows another blowing box arrangement, FIG. 7 shows still another blowing box arrangement, FIG. 8 is a diagram showing the pressure ratio in a blowing box, FIG. 9 is a diagram also showing the pressure ratio in a box, FIG. 10 shows a fluidistor, FIGS. 11*a* and 11*b* show a fluidistor combination, FIG. 12 is a section through a forming station of an alternative embodiment, FIG. 13 is a section through a similar forming station.

In FIG. 1 the numeral 1 designates a distribution chamber, to which particles, fibers or the like are supplied via a distribution conduit 2 through a nozzle 3. The fibers held floating in transport air flow down into the distribution chamber as a particle flow 4 and are precipitated on a running conveyor belt or wire 5. Beneath the conveyor belt 5 a suction box 6 is provided in a conventional manner, and a fan 7 (FIG. 2) is connected to the box for removing the transport air and creating a desired vacuum in the suction box. It is apparent from FIG. 2 how the fibres are precipitated on the running conveyor belt 5, which is endless and runs about the roller 8. On the running belt 5, thus, a fibre mat 9 is formed, the thickness of which successively increases as the belt approaches the discharge opening 10 of the distribution chamber. According to the invention, blowing boxes 11, 12 are arranged adjacent the mouthpiece of the nozzle 3 and are provided with apertures 13, 14 for distributing a control gas 15, 16, which is directed against the composite fiber flow 4. The term composite fibre and, respectively, composite material flow used here and hereinafter also includes the carrier or transport gas. The blowing boxes 11, 12 are connected via distribution passageways 17, 18 to a control device 19, which in its turn is connected to a gas source, for example a fan 20. The function of the control device 19 is to bring about a variable impulse in the control gas flow 15, 16, which is distributed via the blowing boxes 11, 12. The impulse variation is effected so that the gas flow from the fan 20 is distributed by the control device alternatingly to the passageways 17 and 18, respectively. The shiftings take place with a frequency varying between 2 and 20 cycles per second. The control jets 15 and 16, which thus are given their maximum impulse in alternation, are directed against the composite material flow 4, which in itself has an impulse of downward direction from the mouthpiece of the nozzle 3. The periodically shifting impulses from the blowing boxes act upon the downward flowing fibers and impart to them a movement of lateral direction, by which the fibres are spread across the entire width of the web. It was found that a very uniform distribution of the fibres is obtained, for the reason among others that the frequency of variation of the control flow impulse is relatively high in this embodiment of the invention.

The influence of the control flow on the composite material flow, of course, does not only depend on its size, but also on its distance to the composite material flow and its direction in relation thereto. In FIG. 3 which in a schematic manner shows a cross-section of the installation, some dimensions of the installation are defined. The width of the web is designated by b, and the height of the mouthpiece 3 above the web is designated by *h*. The blowing boxes 11, 12 are provided with apertures, which may be distributed over the blowing box plane in different ways. The aperture 13, therefore, here indicates the outlet position for the resultant of the control flow. The position of the outlet aperture in relation to the mouthpiece of the nozzle 3 is designated by *c* and *d*, respectively. As appears from the Figure, the control flow intersects the vertical line of the composite material flow at an angle $\alpha$. The angle of incidence, thus, is oblique in relation to the vertical line, but it may also be perpendicular as shown in FIG. 1. The dashed line indicates the $\alpha_{min}$ of the angle which is determined by the width of the web and the position of the outlet aperture 13. When the angle is smaller than $\alpha_{min}$, the impulse of the control flow in principle is not strong enough to distribute the fibres all the way out to the outer edges of the web, considering an imagined case where the distribution takes place in a vacuum and regard is not paid to the downward directed impulse of the particles nor to the influence of gravity. The fibres flowing downward, however, move at random so that always certain fibres are influenced more than others by the control flow, and a spread farther out in lateral direction is obtained. The angle $\alpha$ may also be greater than 90°, i.e. the control jet may also point in the direction upward to the mouthpiece of the nozzle. The control flow is most efficient when the distance between the aperture 13 and the composite material flow is relatively short. It is possible to position the apertures very closely to the mouthpiece of the nozzle 3 and thereby to obtain a good spread of the fibres. It is apparent from the aforesaid that, depending on the width of the web as it is determined for the application in question, the method according to the invention provides great possibilities to vary the parameters *c, d, h* and $\alpha$ according to fibre quality and thereby render it possible to obtain in each case the desired fibre distribution. Other variable parameters are, for example, the composite material flow rate, the mixing ration beteen fibres and air in the composite flow, and the design of the nozzle 3.

The invention offers also other possibilites for influencing the result. The nature of the control flow, for example, can be adjusted to the application in question by forming the blowing boxes and their apertures in different ways. In FIGS. 4*a*–4*b* some varying forms of blowing boxes are shown. FIG. 4*a* shows a blowing box 11*a* where the apertures for the control flow are nozzles 21, the direction and outflow area of which are adjustable individually for each nozzle. There exists, consequently, a great possibility of adjusting the nature of the control flow FIG. 4*b* shows a blowing box 11*b*, in which the apertures are arranged in two rows 22 and 23, while the apertures in the box 11*c* of FIG. 4*c* consist of slots 24. In FIG. 4*d*, a blowing box 11*d* is shown which includes apertures 25*a* connected to a variable gas source via the connection 26, while the apertures 25*b* are connected to a gas source with constant pressure via the connection 27. The resulting control flow, thus, consists here of a constant basic flow and a variable flow. Also other forms of blowing boxes can be imagined which may be designed as variants of the blowing boxes shown here or as combinations therof. The term blowing box includes here as well as in the attached claims also other forms of distribution means for the control flow, for example nozzle pipes, tubes or hoses provided with nozzles, etc. The control flow apertures in the blowing boxes may also be divided into sections.

In FIG. 5 two opposed blowing boxes 11*e* and 12*e* are shown in a schematic manner, each of which is divided into sections $D_o$ without apertures and sections $D_1$ with apertures 30 for the control flow, the sections $D_o$ in each blowing box being located directly in front of the sections $D_1$ in the opposed blowing box. The composite material flow downward in the perpendicular direction to the plane of the paper in FIG. 5 halfway between the blowing boxes is thereby divided into two material flows, each deflected in one direction. This arrangement of blowing boxes has proved particularly suitable for certain types of fibers.

Another arrangement of opposed blowing boxes is shown in FIG. 6. Each of the blowing boxes 11*f* and, respectively, 12*f* is provided with one or more rows of apertures 33 and, respectively, 34 where these apertures are laterally offset relative to each other, so that a control jet from the aperture 33 will be directed halfway between two opposed apertures 34, and vice versa. This embodiment is particularly suitable for distributing a composite fibre flow consisting of fibres showing the tendency of forming lumps. The control flows jets in this case will have a pronounced tearing-apart effect on the fibre lumps. This disintegration effect is particularly important for certain types of fibres.

In FIG. 7 a further arrangement of blowing boxes is shown, which is particularly suitable in cases when the composite material flow is supplied as a very wide flow or a plurality of adjacent flows, possibly with different fibre qualities of the respective flow in order to form a laminated fibre web. The blowing boxes 35 are disposed in two rows of individual boxes on opposite sides of the composite material flow. The boxes have separate connections 36 for the control gas, so that the volume of the control gas, and the frequency of the pressure variation in the adjacent blowing boxes can be adjusted individually. Furthermore, the variations in adjacent blow boxes may be in phase, may be out of phase, or may have their phasing shifted as desired. By such a phase shifting a very good spread of the fibres is obtained and, consequently, the quality of the material web will be high. In the embodiment shown, the row of blowing boxes is arranged in parallel with the conveying direction of the web, as shown by the arrow 9*a*, but the blowing boxes can also be arranged obliquely to said direction. The latter arrangement can be suitable for webs with a very great width because then depositing of the fibres across the whole web width is ensured.

With reference to FIGS. 8 and 9 showing the pressure on the blowing boxes as a function of the time T, it is illustrated how the impulse of the control flow varies with the time. In the following comments it is presumed that two oppositely directed blowing boxes are used according to any one of the aforedescribed embodiments, but the arrangement can in applicable parts also be used for embodiments with only one blowing box arranged to the side of the composite material flow. It can, however, be stated that the arrangement with two blowing boxes yields by far the best fibre spread and, for several reasons, is the most attractive embodiment of the invention. In FIG. 8, thus, the pressure of one blowing box is indicated along the axis $P_1$ while the pressure of the opposed blowing box is indicated along the axis $P_2$. The axis T designates the time. As the area of the outflow apertures of the blowing boxes is constant, the impulse of the control jets is proportional to the blowing box pressure. As this pressure easily can be recorded, it is stated in the diagram instead of the impulse.

The impulse variations, thus, follow the pressure variations in the blowing boxes. As can be seen in the diagram, when the pressure in one blowing box has reached its maximum value, the pressure in the opposed blowing box has dropped to zero. This pressure progress, and thereby the impulse variation of the control flow, provides a highly efficient spread of the fibres in the composite material flow. The progress shown is also the natural progress, because the same gas source is used for distributing the gas flow via a shifting means to the respective distribution box. In order to effect an efficient spread of particulate material, the frequency of the pressure variations must fall between 1 and 50 cps. No appreciable improvement of the spread of fibrous material is obtained for frequencies below 2 cps or over 20 cps. The optimum frequency for the majority of fibres is about 5–15 cps, but variations on either side of this range may occur, depending on the particle charateristics and the parameters in general, for example blowing box pressures etc. In the figure, the pressure variation is shown as an almost ideal sinusodial shape, but in practice deviations therefrom can occur without thereby adversely influencing the effect.

In FIG. 9 corresponding curves are shown, with the difference that the blowing box pressure in them never drops to zero, but all the time the basic pressure $P_o$ is available. This implies, that the impulse of the control flow never falls below a given minimum value. The advantage thereof is that a stronger effect of the control flows of opposed direction is obtained, and the flows thereby are better capable to disintegrate fibre lumps.

Different arrangements can be chosen for bringing about the variable impulse of the control flow. When opposed boxes are used it is advantageous, as mentioned above, to utilize the same gas source and by some valve means direct the gas flow to one or the other of the blowing boxes. This can, for example, be realized by mechanical valve means or by a mechanical change-over valve of some kind. In FIG. 10, however, a control device is shown which is particularly advantageous for working the invention. The control device designated by 19 in FIG. 6*a* comprises a fluidistor means, the outlet passages 37, 38 of which are connected via the distribution passages 17, 18 to the blowing boxes (FIG. 1). The inlet passage 39 of the fluidistor means is connected via a passage 40 to the outlet of the fan 20, which is driven by a motor 42. The numeral 43 designates the control system used for adjusting the number of motor revolutions and thereby finally the pressure in the blowing boxes and the impulse of the control flow. The fluidistor, which is of so-called bistable type, is in known manner provided with control passageways 44, 45 connected to a control system 46. During operation the air flow automatically chooses the outflow passageway 37 or 38, and by sending via the control system 46 a control impulse in the form of an air shock via one or the other of the control passageways 44 or 45, the fluidistor switches over and distributes the air flow to the other outflow passageway. The shifting frequency, thus, can easily be controlled by the control system 46. The fluidistor can also be designed self-controlling by short-circuiting the control passageways 44 and 45 or, in other words, thereby that the control system 46 simply consists of an intercoupling means for the two passageways. The fluidistor hereby will by itself effect the switching-over in known manner with a certain frequency, which among other things depends on the length of the passageways 44, 45. By varying these lengths, thus, the switch-over frequency of the fluidistor can be varied. This type of self-oscillating fluidistor is particularly suitable for practically working the invention.

The control device may also employ another known type of fluidistors, i.e. an eddy-fluidistor. FIGS. 11*a* and 11*b* show sections of two eddy-fluidistors 50 and 51 connected to out-flow passageways of a control device 19*a*. The passageways are connected via the inlet connections 52, 53 preferably to a gas source, and the out-flow passageways 54, 55 in their turn are connected to the respective blowing box. Within the eddy-fluidistor a disc 56 is provided in known manner. The Figures show by arrows the case when the out-flow from the control fluidistor 19*a* passes through the right-hand outflow passageway, which is indicated by the arrow 57. In the fluidistor 51 then a gas eddy 58 is formed, which gives rise to a high flow resistance through the fluidistor and results in a small outflow as indicated by the arrow 59. In the fluidistor 50, however, the gas flows radially to the outflow aperture according to the arrows 60 and results in a great outflow indicated by the arrow 61. By this arrangement the pressure pulses to the blowing boxes can be increased substantially. It is also possible to position the eddy-fluidistors closer to or within the blowing boxes, and each blowing box aperture can also be provided with an eddy-fluidistor.

In FIGS. 12 and 13 alternative embodiments of the forming station according to the invention are shown. They comprise, like the forming station in FIGS. 1 and 2, a distribution chamber 1*a*, to which a composite material flow is supplied through the nozzle 3*a*. Blowing boxes 11*g*, 12 *g* are provided and connected via distribution passageways 17, 18 to the control device 19. The fibres are deposited or precipitated on a running belt or wire 5*a* running on a bottom portion 70. In the example shown, no suction box is provided beneath the wire. The walls of the distribution chamber consist of two portions 71*a* and 71*b* with an air intake gap 72 therebetween. As appears from the Figures, the nozzle 3*a*, blowing boxes 11*g*, 12*g* and wall portions 71*a* can be regarded per se as a fluidistor where the direction of the composite flow of material discharged through the nozzle 3*a* in the distribution chamber 1*a* is controlled by the control flows from respective blowing boxes. The walls 71*a* are preferably adjustable with respect to position and inclination as indicated by the broken lines in FIG. 12. The system according to FIG. 12 with the wall portions 71*a* arranged at a relatively great distance from the center line of the nozzle 3*a* act here as an analog fluidistor, i.e. the composite material flow through the nozzle 3*a* is distributed laterally, depending on the size of the impulse of the control flow. Hereby an accumulation of fibres at the centre of the web can be obtained, as appears from the cross-sectional profile of the material web shown on a vertically enlarged scale. A corresponding system in FIG. 13, due to the location of the wall portions 71*a* relatively closely to the center line of the nozzle 3*a*, acts as a bistable fluidistor system, i.e. the composite material flow through the nozzle 3*a* to a large extent flows along either of the wall portions 71*a*, due to the coanda-effect. This results in an accumulation of fibres at the edges of the material webs, as shown in the Figure. The invention, thus, offers here an additional method of controlling the fibre distribution.

The invention also renders it possible to supply desired additives to the control flow, which additives may be in the form of powder, fibres, liquid or some other form and are admixed efficiently to the composite material flow supplied through the nozzle 3*a*. FIG. 12 shows a method of supplying additive material through an injector means 80 from a container 81 before the inlet of the fan 20. The material amount supplied can be controlled by a damper or valve arrangement 82. In FIG. 13 an alternative method of supplying additive material to the control flow is shown. In this case some kind of a screw feeder 83 or the like is provided in the distribution pipes 17, 18 whereby the desired amount of additive material can be supplied from the containers 84.

Some of the parameters offered by the invention for controlling the spreading process of the fibres have been mentioned above. It is, of course, also possible to influence the spreading process by increasing or reducing the maximum impulse of the control flow. It can be mentioned that the maximum rate of the control flow at the passage through the apertures in the blowing boxes preferably should be between 50 and 150 meters per second in order to obtain a fully satisfactory effect. As in the case of other forming stations, the suction box beneath the fibre web can be under a certain vacuum, which contributes to a uniform distribution of the fibres. Arrangements without suction box, as shown in FIGS. 12 and 13, are also applicable, but they require the gas flow supplied from the control flow and composite material flow to be exhausted in a different way from the distribution chamber.

One possibility offered by the invention owing to the great control possibilities is to measure by suitable measuring devices the thickness and evenness of the formed fibre web, for example as shown schematically at 91 in FIGS. 1 and 2 and then to return these mesured values to the control system, as indicated at 92, for influencing, as mentioned above, the volume of the control gas, the direction or magnitude of the impulses from the jets 15 and 16, and the frequency of the periodic shifting, which are important for the fibre distribution.

It may, finally, be mentioned that the invention is not restricted only to fibres of wood, but can efficiently be applied to effect spreading and precipitation of other types of fibres or other particles. This is possible because of the great control possibilities of the spreading process which are obtained by the invention. The invention, furthermore, can be utilized for precipitating material webs on surfaces of different kind. As appears from the Figures, the surfaces may be running webs or wires, but also other conveying means can be imagined, for example a drum or the like. For certain applications, the web may also be movable intermittently instead of continuously. The width of the web at the application of the invention can be great compared with the usual width in conventional installations. As an example it can be mentioned that fibreboards with a width of 2.5 meters can be manufactured. When fibre webs with extreme width or thickness are to be manufactured, several forming stations can within the socpe of the invention be arranged either to the side of each other or one after the other along the conveying direction of the web. It is further to be mentioned that the invention is particularly well adapted for combination with methods for orienting the direction of the fibres during the precipitation on the web. This orientation, for example, can be effected thereby that the fibres during the spreading and precipitation process are exposed to an electrostatic field, for example generated by electrodes shown schematically at 93 in FIGS. 1 and 2.

I claim:

1. A method of forming a material web comprising the steps of causing a composite flow of particulate material in a gaseous transport medium flow into a distribution chamber, precipitating said material from said composite flow on a deposition surface in the distribution chamber, exposing the composite material flow to control flows of gaseous medium directed from opposite sides of the flow against the same, and alternatingly varying the size of the impulse of the control flows with a frequency in the range of 1 to 50 c.p.s., each control flow consisting of a plurality of jets, where the impulse of selected jets being varied separately from one another, the variations in said selected jets being out of phase, whereby the composite material flow is distributed across the width of the deposition surface.

2. A method according to claim 1, characterized in that one control flow assumes its maximum value when the opposed control flow assumes its minimum value, and vice versa.

3. A method according to claim 1, characterized in that the impulse of the control flow is varied between zero and a maximum value.

4. A method according to claim 1, characterized in that each control flow consists of jets having a constant basic flow and jets having a variable flow, so that the impulse is varied between the impulse of said basic flow and a maximum value.

5. A method according to claim 1 wherein the range is between 2 and 20 c.p.s.

6. A method according to claim 1 wherein the range is between 5 and 15 c.p.s.

7. A method according to claim 1 characterized in that said jets are opposed and are directed past each other.

8. A method according to claim 1, characterized in that the control flow is adjusted with respect to both its volume and its direction to control the precipitation of material on the deposition surface.

9. A method according to claim 1, characterized in that the impulse of the control flow is varied between maximum and minimum values by fluidistor means.

10. A method according to claim 9, characterized in that the variation is cyclic and is obtained by self-oscillation of the fluidistor means.

11. A method according to claim 1, including the step of supplying a controlled amount of additives to the control flow for admixing in the composite material flow.

12. A method according to claim 1 where the particulate material consists of longitudinal particles or fibres, including the step of orienting the direction of the particles during the spreading and precipitation process in the distribution chamber by exposing the material to an electrostatic field.

13. A method according to claim 1 including the step of moving said deposition surface longitudinally through said chamber as the material is distributed across its width.

14. An apparatus for forming a web of particulate material, comprising a distribution chamber, a deposition surface provided therein, a nozzle opening within the distribution chamber for supplying a composite flow of particulate material distributed in a gaseous medium, and means for distributing the inflowing material across the width of the deposition surface, comprising a supply member for a control gas flow provided on each side of the composite material flow path, said member comprising a blowing box provided with a plurality of aperture means forming impulse jets directed against the composite material flow, a variable-pressure gas source for selected aperture means having means to impart a variable impulse to the control flows to cause said composite flow to be distributed across the full width of the distribution chamber, and a constant-pressure gas source for other aperture means.

15. An apparatus according to claim 14, characterized in that the aperture means consist of holes disposed in rows.

16. An apparatus according to claim 14, characterized in that the aperture means are slots.

17. An apparatus according to claim 14, characterized in that the aperture means of the blowing box are directed in a plane in parallel with the deposition surface.

18. An apparatus according to claim 14, characterized in that the aperture means of the blowing box are directed in a plane oblique to the deposition surface.

19. An apparatus according to claim 14, characterized in that the supply members are disposed at different heights above the deposition surface.

20. An apparatus according to claim 14, characterized in that the supply member comprises blowing boxes disposed opposite each other on different sides of the composite material flow path, the aperture means of said boxes being offset relative to each other.

21. An apparatus according to the claim 14, characterized in that the means effecting said variable impulse of the control flow consist of fluidistor means.

22. An apparatus according to the claim 14, characterized in that the means effecting said variable impulse of the control flow consist of valve means.

23. An apparatus according to the claim 14, characterized in that the deposition surface consists of a movable conveying means.

24. An apparatus according to claim 14 including suction box means beneath the deposition surface.

25. A method of forming a material web comprising the steps of causing a composite flow of particulate material in a gaseous medium transport flow into a distribution chamber, precipitating said material from said composite flow on a deposition surface in the distribution chamber to form a web, exposing the composite material flow to control flows of gaseous medium directed from opposite sides of the flow against the same, alternately varying the size of the impulse of the control flows with a frequency in the range of 1 to 50 c.p.s., each control flow consisting of a plurality of jets, whereby the composite material flow is distributed across the width of the deposition surface, measuring the evenness of the formed web and using the measured values for influencing the variation of the impulse of the control flows.

26. A method of forming a material web comprising the steps of causing a composite flow of particulate material in a gaseous transport medium flow into a distribution chamber along the walls thereof whereby the coanda-effect is utilized for distributing the composite material flow across the chamber, precipitating said material from said composite flow on a deposition surface in the distribution chamber, exposing the composite material flow to control flows of gaseous medium directed from opposite sides of the flow against the same, and alternatingly varying the size of the impulse of the control flows with a frequency in the range of 1 to 50 c.p.s., each control flow consisting of a plurality of jets, whereby the composite material flow is distributed across the width of the deposition surface.

27. An apparatus for forming a web of particulate material, comprising a distribution chamber, a deposition surface provided therein, a nozzle opening within the distribution chamber for supplying a composite flow of particulate material distributed in a gaseous medium, and means for distributing the inflowing material across the width of the deposition surface, comprising a supply member for a control gas flow provided on each side of the composite material flow path, said member comprising a blowing box provided with a plurality of nozzles forming impulse jets directed against the composite material flow, means mounting said nozzles for individual adjustments of their direction or outlet area, and a gas source for said member having means to impart a variable impulse to the control flows to cause said composite flow to be distributed across the full width of the distribution chamber.

28. An apparatus for forming a web of particulate material, comprising a distribution chamber, a deposition surface disposed in a plane therein, a nozzle opening within the distribution chamber for supplying a composite flow of particulate material distributed in a gaseous medium, and means for distributing the inflowing material across the width of the deposition surface, comprising a supply member for a control gas flow provided on each side of the composite material flow path, said member comprising a blowing box provided with a plurality of aperture means forming impulse jets directed against the composite material flow, mounting means to adjust the directions of said aperture means relative to the plane of the deposition surface, and a gas source for said member having means to impart a variable impulse to the control flows to cause said composite flow to be distributed across the full width of the distribution chamber.

29. An apparatus for forming a web of particulate material, comprising a distribution chamber, a deposition surface provided therein, a nozzle opening within the distribution chamber for supplying a composite flow of particulate material distributed in a gaseous medium, and means for distributing the inflowing material across the width of the deposition surface, comprising a supply member for a control gas flow provided on each side of the composite material flow path, each of said members comprising blowing box sections provided with a plurality of aperture means forming impulse jets directed against the composite material flow, alternating with blowing box sections without aperture means, the sections with aperture means on one side of the flow path being opposite the section without aperture means on the other side of the flow path, and a gas source for said members having means to impart a variable impulse to the control flows to cause said composite flow to be distributed across the full width of the distribution chamber.

30. An apparatus for forming a web of particulate material, comprising a distribution chamber, a deposition surface provided therein, a nozzle opening within the distribution chamber for supplying a composite flow of particulate material distributed in a gaseous medium, and means for distributing the inflowing material across the width of the deposition surface, comprising a supply member for a control gas flow provided on each side of the composite material flow path, said member comprising a blowing box provided with a plurality of aperture means forming impulse jets directed against the composite material flow, and a gas source for said member having at least one self-oscillating fluidistor means to impart a variable impulse to the control flows to cause said composite flow to be distributed across the full width of the distribution chamber.

31. An apparatus for forming a web of particulate material, comprising a distribution chamber, a deposition surface provided therein, a nozzle opening within the distribution chamber for supplying a composite flow of particulate material distributed in a gaseous medium, and means for distributing the inflowing material across the width of the deposition surface, comprising a supply member for a control gas flow provided on each side of the composite material flow path, said member comprising a blowing box provided with a plurality of aperture means forming impulse jets directed against the composite material flow, a gas source for said member having means to impart a variable impulse to the control flows to cause said composite flow to be distributed across the full width of the distribution chamber, and means for supplying additive material to the control flow.

32. An apparatus for forming a web of particulate material, comprising a distribution chamber, a deposition surface provided therein, a nozzle opening within the distribution chamber for supplying a composite flow of particulate material distributed in a gaseous medium, side wall portions extending from the nozzle to the deposition surface, and means for distributing the inflowing material across the width of the deposition surface, comprising a supply member for a control gas flow provided on each side of the composite material flow path, said member comprising a blowing box provided with a plurality of aperture means forming impulse jets directed against the composite material flow, and a gas source for said member having means to impart a variable impulse to the control flows to cause said composite flow to be distributed across the full width of the distribution chamber, said nozzle, said supply member, and said side wall portions being designed so as to act as a fluidistor.

33. An apparatus according to claim 32, characterized in that the wall portions are adjustable with respect to inclination.

* * * * *

UNITED STATES PATENT OFFICE

CERTIFICATE OF CORRECTION

Patent No. 4,099,296 Dated July 11, 1978

Inventor(s) Lennart Gustavsson

It is certified that error appears in the above-identified patent and that said Letters Patent are hereby corrected as shown below:

Col. 3, line 40, "beteen" should be --between--;

Col. 3, line 46, "4a-4b" should be --4a-4d--;

Col. 4, line 22, "flows" should be --flow--;

Col. 5, line 42, "6a" should be --10--;

Col. 7, line 33, "mesured" should be --measured--;

Col. 7, line 57, "socpe" should be --scope--.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*